US006756721B2

(12) United States Patent
Higashi et al.

(10) Patent No.: US 6,756,721 B2
(45) Date of Patent: Jun. 29, 2004

(54) METAL HALIDE LAMP

(75) Inventors: Masanori Higashi, Osaka (JP); Yoshiharu Nishiura, Shiga (JP); Shigefumi Oda, Osaka (JP); Shunsuke Kakisaka, Osaka (JP); Hiroshi Enami, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/185,793

(22) Filed: Jun. 27, 2002

(65) Prior Publication Data

US 2003/0015949 A1 Jan. 23, 2003

(30) Foreign Application Priority Data

Jun. 28, 2001 (JP) ..... 2001-197146

(51) Int. Cl.[7] ..... H01J 7/24; H01J 1/02; H01J 61/52; H01K 1/58

(52) U.S. Cl. ..... 313/17; 313/567; 313/637

(58) Field of Search ..... 313/17, 567, 637

(56) References Cited

U.S. PATENT DOCUMENTS

| | | | | |
|---|---|---|---|---|
| 3,786,297 | A | | 1/1974 | Zollweg et al. |
| 3,798,487 | A | | 3/1974 | Zollweg et al. |
| 4,024,425 | A | * | 5/1977 | Higashi et al. ..... 313/562 |
| 4,422,011 | A | | 12/1983 | Bruninx-Poesen et al. |
| 4,634,927 | A | | 1/1987 | Mori et al. |
| 4,801,846 | A | | 1/1989 | Kramer et al. |
| 4,810,938 | A | | 3/1989 | Johnson et al. |
| 4,972,120 | A | | 11/1990 | Witting |
| 4,978,884 | A | | 12/1990 | Van Vliet et al. |
| 5,239,232 | A | | 8/1993 | Heider et al. |
| 5,464,462 | A | | 11/1995 | Langer et al. |
| 5,773,932 | A | | 6/1998 | Ooyama et al. |
| 5,905,341 | A | | 5/1999 | Ikeuchi et al. |
| 5,936,351 | A | | 8/1999 | Lang |
| 5,973,453 | A | | 10/1999 | Van Vliet et al. |
| 5,973,454 | A | | 10/1999 | Ooyama et al. |
| 6,054,810 | A | | 4/2000 | Yamamoto et al. |
| 6,069,456 | A | | 5/2000 | Fromm et al. |
| 6,118,216 | A | | 9/2000 | Marlor |
| 6,501,220 | B1 | | 12/2002 | Lambrechts et al. |

FOREIGN PATENT DOCUMENTS

| | | |
|---|---|---|
| EP | 0 049 545 | 4/1982 |
| EP | 0 453 893 | 10/1991 |
| EP | 0 905 744 | 3/1999 |
| EP | 1 271 614 | 1/2003 |
| JP | 54-102070 | 8/1979 |
| JP | 57-92747 | 6/1982 |
| JP | 8-36994 | 2/1996 |
| JP | 10-144261 | 5/1998 |
| JP | 2000-501563 | 2/2000 |
| WO | WO 98/25294 | 6/1998 |

OTHER PUBLICATIONS

European Search Report.

* cited by examiner

*Primary Examiner*—Alan Cariaso
*Assistant Examiner*—Sumati Krishnan
(74) *Attorney, Agent, or Firm*—Merchant & Gould P.C.

(57) ABSTRACT

A metal halide lamp has an arc tube including an envelope as an arc tube container made of an oxide-based translucent ceramic material, and the arc tube is filled with luminescent materials comprising at least a cerium halide, a sodium halide, a thallium halide and an indium halide. An amount of the cerium halide is in a range from 20 wt % to 69.0 wt %, an amount of the sodium halide is in a range from 30 wt % to 79.0 wt %, and a total amount of the thallium halide and the indium halide is in a range from 1.0 wt % to 20 wt % with respect to the entire metal halides. Accordingly, the arc discharge is spread, bending of the arc discharge toward the arc tube wall is suppressed, and thus, the metal halide lamp has improved luminescent efficiency, where lowering of the flux maintenance factor is suppressed even after a long-time use, and hues of the luminescent colors are corrected.

8 Claims, 6 Drawing Sheets

METAL HALIDE LAMP

FIELD OF THE INVENTION

The present invention relates to an arc tube used for a metal halide lamp.

BACKGROUND OF THE INVENTION

Metal halide lamps using ceramic arc tubes have been used widely for indoor lighting in stores and shops because such metal halide lamps have higher luminous efficiency, higher color rendering and longer service lives when compared to metal halide lamps using quartz arc tubes.

FIGS. 5 and 6 show respectively a metal halide lamp using a conventional ceramic arc tube. An arc tube 28 comprises an arc tube container 29 composed of a discharge arc tube portion 30 of a polycrystalline alumina ceramic material and a pair of thin tube portions (31,32) sintered at the both ends of the discharge arc tube portion 30. A pair of tungsten coil electrodes (33,34) are arranged at the both ends of the arc tube 28. Feeding portions (35,36) of niobium or conductive cermet are adhered hermetically to the thin tube portions (31,32) by means of frit 37, and the tungsten electrodes (33, 34) are connected to the respective feeding portions (35,36). A luminescent material 38 comprising a metal halide, mercury as a buffer gas, and a start-aiding rare gas such as argon are filled in the arc tube 28. As illustrated in FIG. 6, the arc tube 28 composing a lamp 39 is disposed inside an outer bulb 40 of either quartz or hard glass, and a base 41 is attached to the outer bulb 40. About 50 kPa of a nitrogen-based gas is filled in the outer bulb 40. In general, the lamp 39 is turned on by means of a copper-iron inductance ballast or an electron ballast with a built-in starter.

For example, references such as JP-57(1982)-92747 A and U.S. Pat. No. 5,973,453 describe the use of cerium iodide in combination with sodium iodide for a luminescent material applicable for a typical metal halide lamp for indoor/outdoor use. The luminescent material of cerium iodide can provide improved luminous efficiency since many of the emission spectra of cerium are distributed in a region with a higher relative luminosity factor regarding human eyes. U.S. Pat. No. 5,973,453 and Tokuhyo-2000-501563 (published Japanese translation of PCT international publication for patent application) describe a suitable NaI/$CeI_3$ molar composition ratio in a range from 3 to 25 (corresponding to a $CeI_3$ composition ratio from 12.2 wt % to 53.7 wt %), which is suitable for obtaining white light source color.

However, a conventional metal halide lamp filled with a luminescent material of cerium iodide and sodium iodide has a problem of a drastic change in the lamp color temperature as well as a remarkable lowering in the flux maintenance factor over the lighting time.

SUMMARY OF THE INVENTION

For solving the above-described problems, a metal halide lamp according to the present invention comprises an arc tube having an envelope as an arc tube container made of an oxide-based translucent ceramic material, and the arc tube is filled with a luminescent materials comprising at least a cerium halide, a sodium halide, a thallium halide and an indium halide.

DETAILED DESCRIPTION OF THE INVENTION

Figure 1:
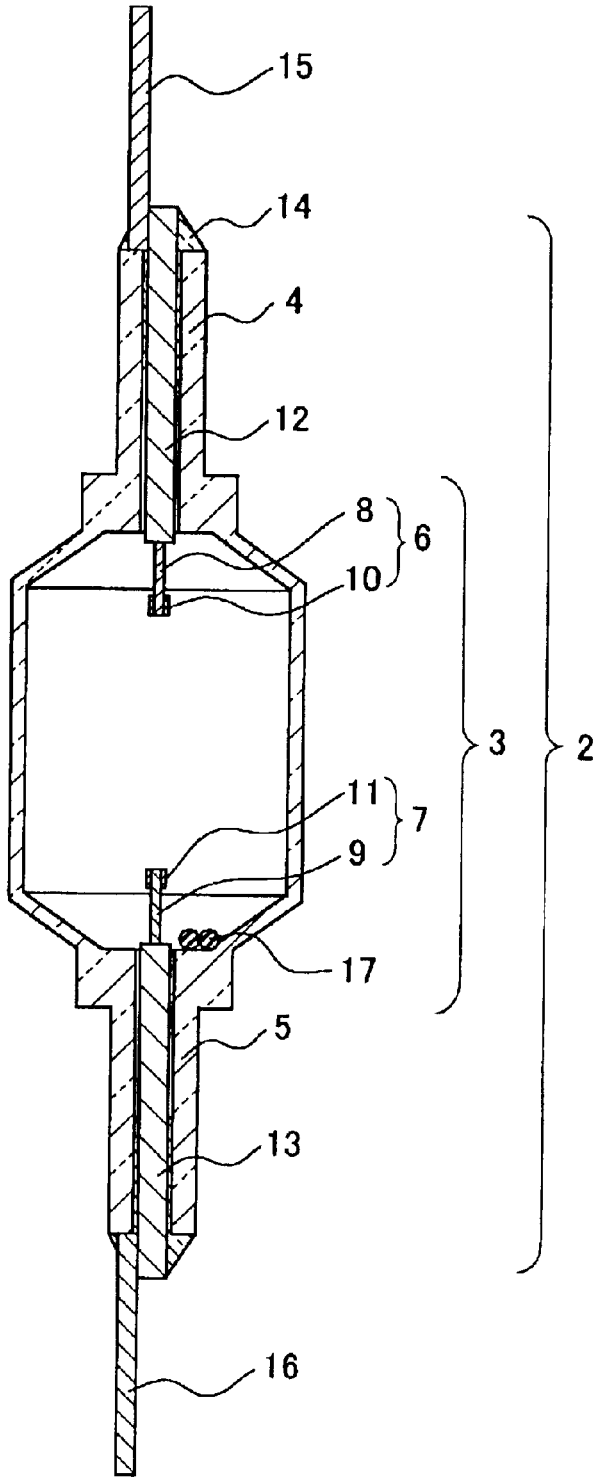
FIG. 1 shows a structure of an arc tube of a metal halide lamp in one embodiment of the present invention.

A metal halide lamp arc tube according to the present invention can be identical to that of a conventional technique, or a conventional metal halide lamp arc tube can be applied to the present invention. The present invention provides a material in order to maintain a high flux maintenance factor while preventing a drastic change in the lamp color temperature.

In the above-described metal halide lamp, it is preferred that an amount of the cerium halide is in a range from 20 wt % to 69.0 wt %, an amount of the sodium halide is from 30 wt % to 79.0 wt %, and a total amount of the thallium halide and the indium halide is from 1.0 wt % to 20 wt % with respect to the entire metal halides. It is particularly preferred that the amount of the thallium halide is from 1.0 wt % to 7.0 wt %, and a ratio of the thallium halide to the indium halide filled is $0.6 \leqq$ TlX wt %/InX wt % $<4.0$, when X denotes halogen. A preferred halogen is either bromine (Br) or iodine (I).

When the amount of the cerium halide is less than 20 wt %, the color temperature becomes extremely low, i.e., 3000 K or lower. When the amount exceeds 69.0 wt %, the arc becomes unstable and the service life is shortened.

When the amount of the sodium halide is less than 30 wt %, the service life will be shortened. When the amount exceeds 79.0 wt %, the color temperature will be extremely low.

When the total amount of the thallium halide and the indium halide is less than 1.0 wt %, the colors of lamps can vary. When the amount exceeds 20 wt %, the flux can be lowered. For example, since TlI and InI are luminescent materials having bright line spectra respectively around 546 nm and 450 nm, the luminous efficiency provided by these materials will deteriorate due to self-absorption when the filling amount is excessive. It is preferable to limit the filling amounts when the luminescent efficiency of the lamp is to be emphasized.

The thallium halide in an amount of less than 1.0 wt % tends not to provide a sufficient effect, while the light color tends to shift to a green side excessively when the amount exceeds 7.0 wt %.

When the ratio of the thallium halide to the indium halide is less than 0.6, the luminescent efficiency of the lamp tends to be lowered remarkably. When the same ratio exceeds 4.0, a green color will be remarkable.

It is preferable in the metal halide lamp that the rated service life is at least 12000 hrs and the flux maintenance factor is at least 60%.

Consequently, a metal halide lamp according to the present invention can have a spread arc discharge while bending of the arc discharge towards the arc tube wall can be suppressed. As a result, the flux maintenance factor is prevented from lowering even after a long-time use, a hue of the luminescent color can be corrected, and thus the lamp can have a longer service life. Furthermore, the luminescent efficiency can be improved by optimization of the filling amount of the thallium halide having a high relative luminosity factor. Thus, the metal halide lamp emitting white light has a high-wattage, a long service life, and high luminous efficiency and it can be applied widely for indoor and outdoor use.

Embodiments of the present invention will be described below by referring to FIGS. 1 and 2.

Figure 2:
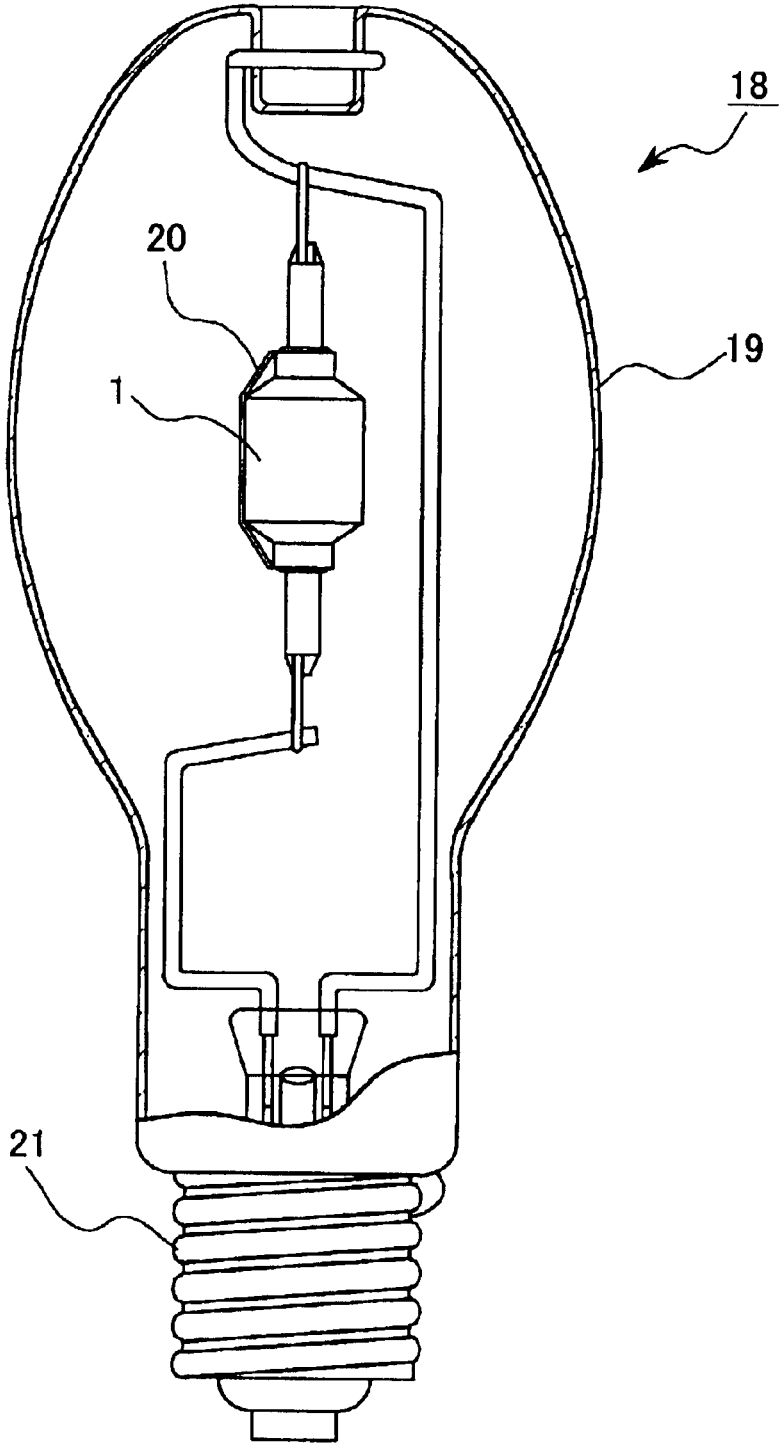
FIG. 2 is a general view of a metal halide lamp in one embodiment of the present invention.

FIGS. 1 and 2 respectively show structures of an arc tube of a metal halide lamp having an alumina ceramic tube with 200 W, and an entire lamp including the arc tube.

An arc tube 1 comprises an arc tube container 2 composed of a discharge arc tube portion 3 made of a polycrystalline alumina ceramic and a pair of thin tubes (4, 5) sintered at the both ends of the discharge arc tube portion 3. The arc tube container 2 is not limited to the polycrystalline alumina ceramic but any oxide-based translucent ceramics can be used similarly. For example, $Al_2O_3$ (alumina), $Y_3Al_5O_3$ (YAG), BeO, MgO, $Y_2O_3$, $Yb_2O_3$, and $ZrO_2$ can be used.

A pair of tungsten coil electrodes (6,7) are formed at the both ends of the arc tube 1, and the respective tungsten coil electrodes (6,7) comprise tungsten electrode rods (8,9) and tungsten coils (10,11). The electrodes are arranged with a distance of 18.0 mm. Feeding portions (12,13) of a conductive cermet are adhered hermetically to the thin tube portions (4,5) by means of frit 14. Each of the tungsten rods (8,9) is welded to one end of each of the feeding portions (12,13), while niobium outer leads (15, 16) are welded to the other ends of the feeding portions (12,13) respectively. A cerium halide-based luminescent material 17, mercury as a buffer gas and a start-aiding rare gas containing an argon gas are filled in the arc tube 1.

FIG. 2 is a general view of a lamp 18 comprising the arc tube 1. The arc tube 1 is arranged in the interior of an outer bulb 19 made of hard glass. For further lowering the lamp starting voltage, a start-aiding conductor 20 made of a molybdenum wire is attached along the discharge arc tube portion 3 of the arc tube container 2. An inert gas such as a 50 kP of a nitrogen gas is filled in the outer bulb 19. The interior of the outer bulb can be evacuated. Numeral 21 denotes a base.

EXAMPLE 1

A lamp 18 was prepared for measuring the initial properties and flux maintenance factor in aging. The lamp 18 was filled with a luminescent material 17 comprising 2.4 mg (40.0 wt %) of $CeI_3$, 3.15 mg (52.5 wt %) of NaI, 0.27 mg (4.5 wt %) of TlI, and 0.18 mg (3.0 wt %) of InI.

It was observed that the arc discharge was spread due to the presence of TlI and InI, and bending of the arc discharge towards the upper part and side of the arc tube was suppressed. The flux maintenance factor of the lamp 18 in aging was improved, i.e., it was at least 60% at a point of 12000 hrs (rated service life). The reason is as follows. Since an average excitation voltage Ve of thallium and indium is higher than the ionization potential Vi (Ve>0.585 Vi), the arc discharge can be spread as described above.

With regard to improvement of the initial luminous efficiency, filling of thallium iodide was particularly effective, since thallium iodide radiates 546 nm green light having a high relative luminosity factor. Since the TlI may shift the lamp luminescent color to a green side, indium iodide (InI) radiating 450 nm blue light is filled for the correction. That is, a filling amount of TlI should be in a proper range for preventing the luminescent color to shifted to the green side, and the composition ratio of TlI and InI should be selected properly in order to provide a white light source color that can be used for general indoor and outdoor lighting.

EXAMPLE 2

Similar to Example 1, a lamp 18 was prepared for measuring the initial properties and flux maintenance factor in aging. The lamp 18 was filled with a luminescent material 17 comprising 2.5 mg of $CeI_3$, 3.0 mg of NaI, and a combination of TlI and InI whose compositions are varied in a range from 0 to 15 wt %.

Figure 3:
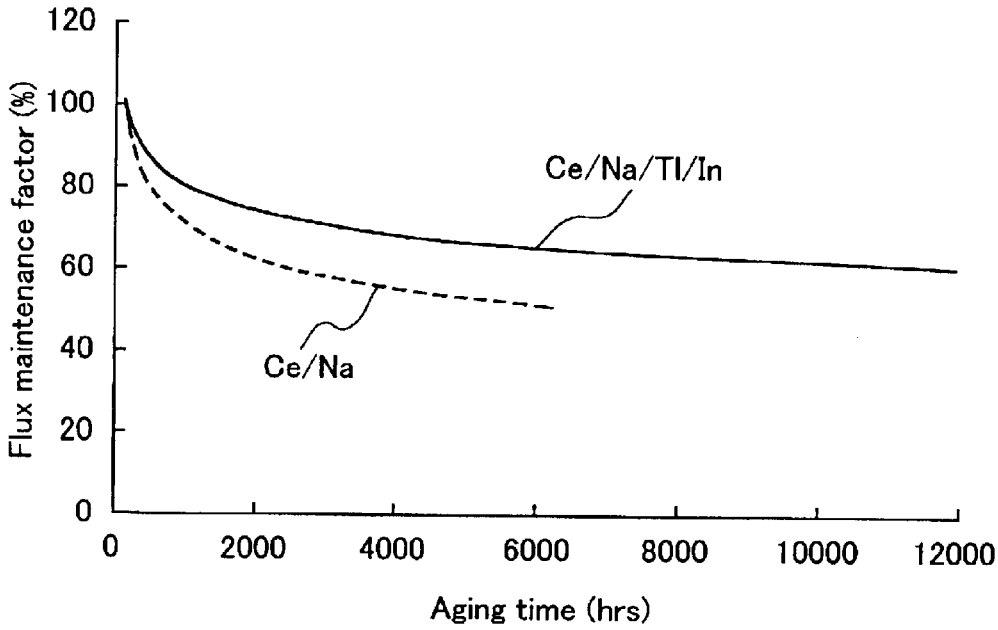
FIG. 3 is a graph showing a flux maintenance factor in aging for a metal halide lamp in Example 1 of the present invention.

It was observed that the arc discharge was spread and its bending towards the arc tube wall was suppressed when more TlI and InI were filled. The flux maintenance factor of the lamp 18 in aging was further improved, and a rated service life was improved. That is, the flux maintenance factor was at least 60% at a point of 12000 hrs as long as the filling amount of TlI and InI is in a range of $1.0 \leqq$ TlI wt $\% \leqq 7.0$ and also $0.6 \leqq$ TlI wt %/InI wt $\% \leqq 4.0$. The result is shown as a line of Ce/Na/Tl/In in FIG. 3. The reason is as follows. Since the average excitation voltage Ve of thallium and indium is higher than the ionization potential Vi (Ve>0.585 Vi), the arc discharge was spread effectively. Relatively small amounts of TlI and InI (the total amount was 3.0 wt % or more) served to provide a relatively remarkable spreading of the arc discharge, and the service life was as long as 12000 hrs.

With regard to improvement of the initial luminous efficiency, filling of thallium iodide was effective particularly, since thallium iodide radiates 546 nm green light having a high relative luminosity factor. Since the TlI may shift the lamp luminescent color to a green side, indium iodide (InI) radiating 450 nm blue light is filled for the correction. That is, a filling amount of TlI should be in a proper range for preventing the luminescent color to be shift to the green side, and the composition ratio of TlI to InI should be selected properly in order to provide white light source color that can be used for general indoor and outdoor lighting. It was found that when $1.0 \leqq$ TlI wt $\% \leqq 7.0$ and also $0.6 \leqq$ TlI wt %/InI wt $\% \leqq 4.0$, the luminescent efficiency exceeds the desired value of 117 lm/W and the obtained white light source color can be applied generally for indoor/outdoor use.

Figure 4:
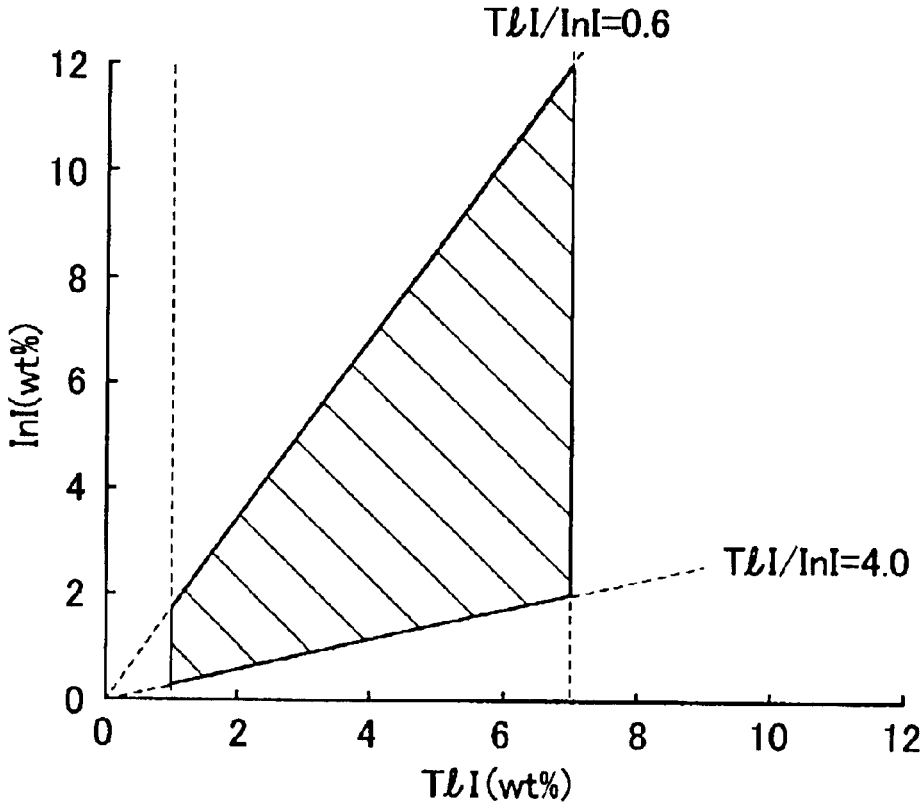
FIG. 4 is a graph showing a preferred composition range in Example 2 of the present invention.
Figure 5:
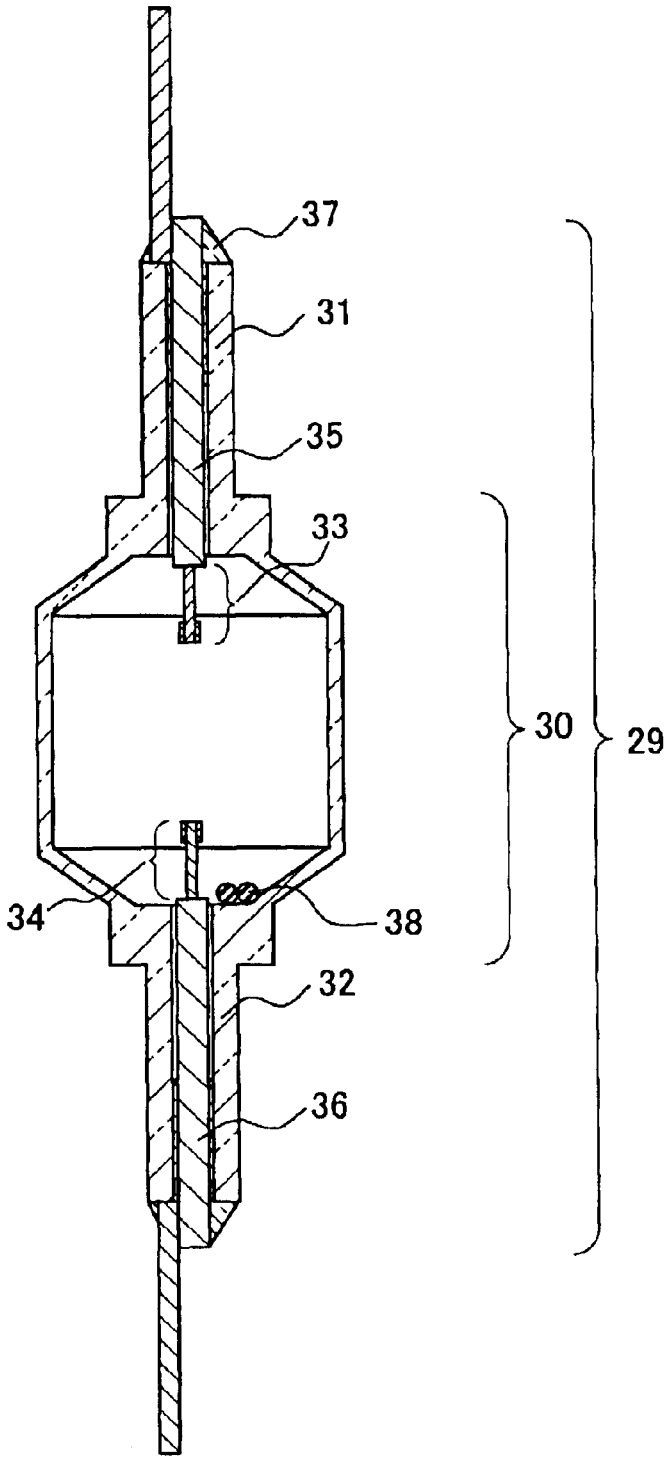
FIG.5 PRIOR ART
FIG. 5 shows a structure of an arc tube of a conventional metal halide lamp.
Figure 6:
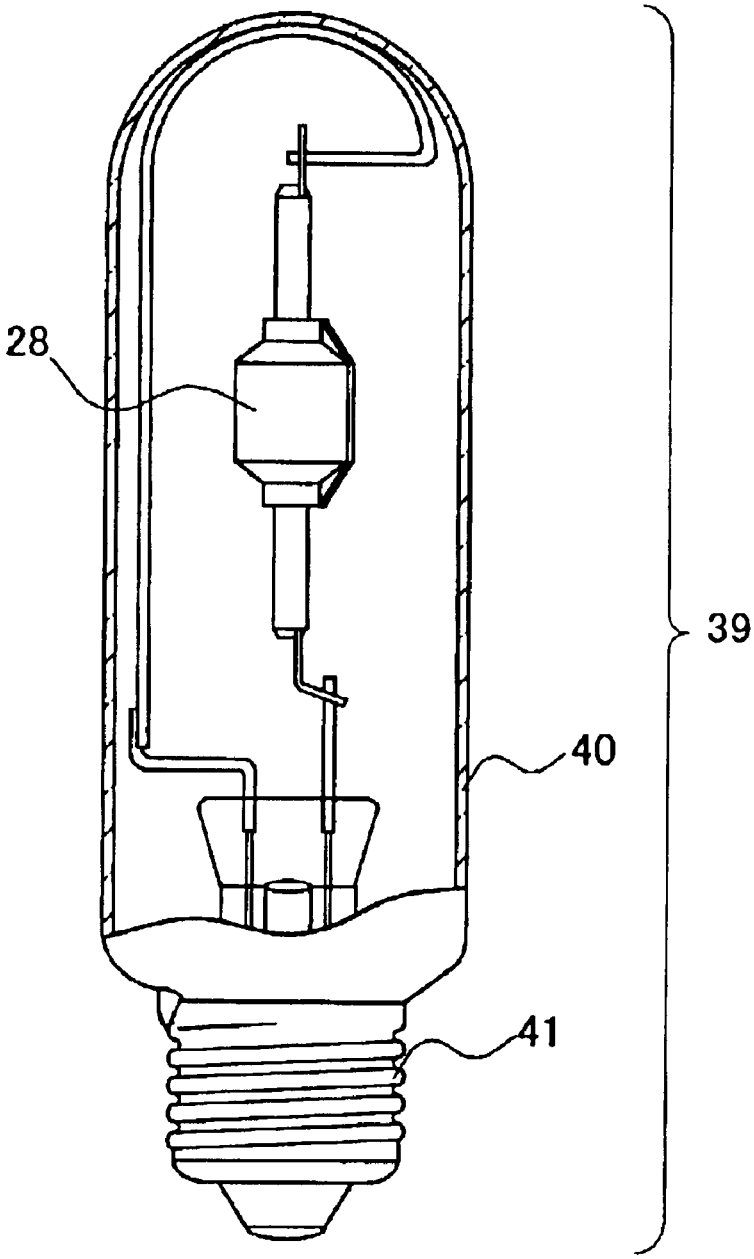
FIG.6 PRIOR ART
FIG. 6 is a general view of a conventional metal halide lamp.

FIG. 4 illustrates a preferred range of compositions of Example 2.

COMPARATIVE EXAMPLE 1

A lamp 18 comprising a conventional arc tube 1 was prepared. The lamp 18 was filled with 6 mg of a luminescent material 17 composed of cerium-sodium iodides (36 wt % (13.9 mol %) of $CeI_3$+64 wt % (86.1 mol %) of NaI). This NaI/$CeI_3$ composition ratio according to the conventional technique provides a white light source color in a range from about 3500 K to about 4000 K.

First, the initial properties of the lamp were measured at an aging time of 100 hrs. For a white light source color having a color temperature of 4100 K, the lamp flux was 23600 lm and the luminous efficiency was 118 ml/W (both are average values of four lamps). Namely, a desired value (117 ml/W) of luminous efficiency was obtained barely, though the general color rendering index was 60, i.e., lower than the desired value of 65.

Next, a lamp aging test was carried out for measuring the flux maintenance factor. As illustrated by the line of Ce/Na in FIG. 3, the flux maintenance factor dropped to 50% within the aging time of about 6800 hrs. Generally, a lifetime of a metal halide lamp is defined by an aging time at which a flux maintenance factor drops to 50%. The lamp light color was lowered gradually from the initial value of 4100 K to 3700 K during the service life of 5000 hrs.

An analysis of the alumina ceramic arc tube after the aging showed that the inner wall of the arc tube was corroded by a reaction with the cerium, and the corrosion was relatively remarkable at the upper part of the arc tube. After the aging time of 5000 hrs, a large amount (90% of the initial amount) of NaI remained in the tube while $CeI_3$ was decreased drastically, i.e., 40–60% of its initial filling amount.

Luminescent materials in the present invention are not specifically limited to the quaternary system of a cerium halide, a sodium halide, a thallium halide and an indium halide described in the above Example 2, but a scandium halide and a lanthanoid-based halide can be included as a fifth and a sixth substances as long as the compositions of the cerium halide and sodium halide are in the above-described range.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, all changes that come within the meaning and range of equivalency of the claims are intended to be embraced therein.

What is claimed:

1. A metal halide lamp comprising an arc tube having an arc tube container as an envelope made of oxide-based translucent ceramic material that forms a discharge arc tube portion, the arc tube is filled with luminescent materials comprising at least a cerium halide, a sodium halide, a thallium halide and an indium halide.

wherein an amount of the cerium halide is in a range from 20 wt % to 69.0 wt %, an amount of the sodium halide is in a range from 30 wt % to 79.0 wt %, and a total amount of the thallium halide and the indium halide is in a range from 1.0 wt % to 20 wt % with respect to the entire metal halides.

2. The metal halide lamp according to claim 1, wherein an amount of the thallium halide is in a range from 1.0 wt % to 7.0 wt %, with respect to the entire metal halides, and a ratio of the amount of the thallium halide to the filled indium halide is in a range from $0.6 \leqq TlX$ wt %/InX wt % $\leqq 4.0$, where X denotes halogen.

3. The metal halide lamp according to claim 1, wherein the oxide based translucent ceramic material is at least one ceramic selected from the group consisting of polycrystalline alumina ceramic, $Al_2O_3$ (alumina), $Y_3Al_5O_3$, BeO, MgO, $Y_2O_3$, $Yb_2O_3$and $ZrO_2$.

4. The metal halide lamp according to claim 1, wherein the halogen of the halide is iodine.

5. The metal halide lamp according to claim 1, wherein an outer bulb of hard glass is formed outside the arc tube.

6. The metal halide lamp according to claim 5, wherein an inert gas is filled in the outer bulb.

7. The metal halide lamp according to claim 1, wherein a start-aiding conductor is attached along the discharge arc tube portion of the arc tube container, and the start-aiding conductor lowers the lamp starting voltage.

8. The metal halide lamp according to claim 1, wherein the metal halide lamp has a rated service life of at least 12000 hrs and a flux maintenance factor of at least 60%.

* * * * *